US005839844A

United States Patent [19]

Nichols et al.

[11] Patent Number: 5,839,844

[45] Date of Patent: Nov. 24, 1998

[54] LEACHING CHAMBER ENDPLATE

[75] Inventors: James M. Nichols, Old Saybrook; Bryan A. Coppes, Clinton, both of Conn.

[73] Assignee: Infiltrator Systems, Inc., Old Saybrook, Conn.

[21] Appl. No.: 489,693

[22] Filed: Jun. 12, 1995

[51] Int. Cl.[6] ..... E02B 13/00; E02B 13/02

[52] U.S. Cl. ..... 405/43; 405/45; 405/48; 405/124

[58] Field of Search ..... 405/43, 48, 45, 405/124, 36, 52, 118

[56] References Cited

U.S. PATENT DOCUMENTS

| | | | |
|---|---|---|---|
| 4,759,661 | 7/1988 | Nichols et al. | 405/48 |
| 5,017,041 | 5/1991 | Nichols | 405/48 |
| 5,087,151 | 2/1992 | DiTullio | 405/43 |
| 5,156,488 | 10/1992 | Nichols | 405/48 |
| 5,336,017 | 8/1994 | Nichols | 405/43 X |
| 5,441,363 | 8/1995 | Gray | 405/45 |

*Primary Examiner*—Ramon S. Britts
*Assistant Examiner*—Tara L. Mayo
*Attorney, Agent, or Firm*—C. G. Nessler

[57] ABSTRACT

The endplate of an arch shape cross section leaching chamber for dispersing liquid in soil has an inlet duct which enables the pipe delivering liquid to the chamber to be at higher elevation than the top of the chamber. Liquid flowing from the duct is guided downwardly by a channel and onto an integral baseplate extending into the chamber, to lessen any erosion of the soil within the open bottom of the chamber. Preferably, the endplate has double walls which, with sidewalls, form the channel. And, a slot opening near the bottom of the inner wall discharges the liquid into the chamber interior.

15 Claims, 2 Drawing Sheets

LEACHING CHAMBER ENDPLATE

TECHNICAL FIELD

The present invention relates to chambers for dispersing liquids in soil. Most particularly the invention relates to end plates for arch shape leaching chambers.

BACKGROUND

Molded plastic leaching chambers (also referred to as leaching conduits), especially those sold under the registered U.S. trademark "Infiltrator", have met substantial commercial success. Examples of such type of chambers are shown in U.S. Pat. No. 4,759,661 to May and Nichols; and, in U.S. Pat. Nos. 5,017,041, 5,156,488 and 5,336,017 all to Nichols, all of which patents have an inventor and assignee in common herewith.

Generally, the successful molded plastic leaching chambers are arch shaped, have corrugations running along the arch shape, have open bottoms, and have sidewalls with perforations typically slots. In use, chambers are placed in a trench in the soil, connected one to the other as a string. The two chamber openings at the opposing ends of the string are closed with endplates. Typically, there is an opening at one of the endplates, or elsewhere such as on the top or side of the chamber itself, to receive a pipe which introduces liquid into the chamber string. The liquid to be dispersed, e.g. storm water or effluent from a septic tank, is typically delivered to the buried chambers by gravity flow through a 4 inch pipe.

Liquid introduced into a chamber leaches into the soil, both by flowing downwardly and by flowing through the chamber sidewall perforations. Generally, it is desirable that the perforations be placed at as great an elevation as possible, to maximize the chamber's liquid dispersing capacity. Liquid may accumulate inside the chamber when the inflow is greater than the dispersal of liquid into the surrounding soil. Thus, it is desirable that a leaching chamber have capacity for such accumulation by filling to the maximum extent possible.

However, as a general engineering principle, liquid flowing in the inlet pipe ought not be allowed to stagnate, such as can occur if the chamber fills above the level of the "invert", or bottom of the inlet pipe cross section. Accordingly, sanitary regulations only give design credit to chamber sidewall perforations which are lower in elevation than the invert height. Thus, since the inlet invert height limits both liquid dispersal capacity and storage capacity, the inlet pipe has been heretofore connected at the highest possible elevation on the endplate.

A favored approach for maximizing inlet pipe invert height on leaching chambers has been to mold a semi-circular subarch into the top of the chamber end, which when mated with a like semi-circular cutout at the top of the endplate, provides a circular opening for an inlet pipe. In such design the top of the inlet pipe is nominally level with the top of the end of the chamber; and the invert height is slightly more than an inlet pipe diameter but less than the height of the end of the chamber. See FIGS. 7 and 11 of U.S. Pat. No. 5,017,041.

Another factor relating to inlet pipes is the prevention of erosion of the soil inside the chamber, at its base, as liquid drops from the invert height. When such erosion is of concern, a typical practice has been to position a splash plate, such as a brick or stone, on the soil below the inlet pipe. Sometimes, a piece of molded plastic has been fastened to the bottom of the endplate, to project from the bottom of the endplate. While such practices are generally effective, the installation of an additional component in a field operation has an attendant cost and risk of omission.

Thus, there has been a need for improving the means for introducing liquids into leaching chambers, in a way which meets or exceeds the goals in the prior art, in an economic and simple fashion.

SUMMARY

An object of the invention is to introduce liquids into a leaching chamber at the endplate, in a manner which maximizes the utilization of a leaching chamber. A further object of the invention is to provide an economic endplate construction which provides an inlet pipe invert greater than heretofore and which minimizes the tendency for soil erosion inside a chamber.

In accord with the invention, a leaching chamber has an endplate with a wall that closes a chamber open end. The endplate has a duct attached at a hole in the upper end of the wall; the duct extends away from the chamber, terminating at an inlet end adapted to receive a pipe carrying liquid to the chamber. The top part of the duct inlet is higher in elevation than the top part of the chamber proximate the endplate. Preferably, the invert height of the inlet is equal or greater than the elevation of the perforations of the chamber sidewalls. The endplate design permits full utilization of the openings in the chamber sidewall, even when liquid accumulates in the chamber, since the invert height of the inlet may be positioned at or above the level of the chamber sidewall openings.

In accord with another aspect of the invention, the endplate closing the end of the chamber has a channel which guides liquid falling from the endplate opening toward the base of the chamber. Preferably, the endplate has a longitudinally extending base which protects the soil where the liquid falls to the base of the chamber. More preferably, the endplate has a double wall construction, so that the channel is comprised of an inner and outer endplate wall, in combination with connecting sidewalls. Most preferably, the inner wall extends the whole vertical length of the chamber and there is a slot opening in the inner wall, vertically spaced apart from the baseplate, to allow liquid to flow into the chamber from the channel. In such design, there is a cavity at the bottom of the endplate interior, below the channel, to receive and slow the flow of liquid.

The foregoing and other features and advantages of the inventions will be further understood by the description which follows.

DESCRIPTION

The invention is described in terms of application and use of leaching chambers described in the patents mentioned in the Background, the disclosures of which are hereby incorporated by reference. The endplate is of course useable with other chamber designs. The endplate is preferably made from molded high density polyethylene with general characteristics similar to those seen heretofore in chambers. Preferably, endplates are made by blow molding; alternately, by injection molding. While the endplates are preferably molded as one piece, they may be assembled of separate pieces.

Figure 1:
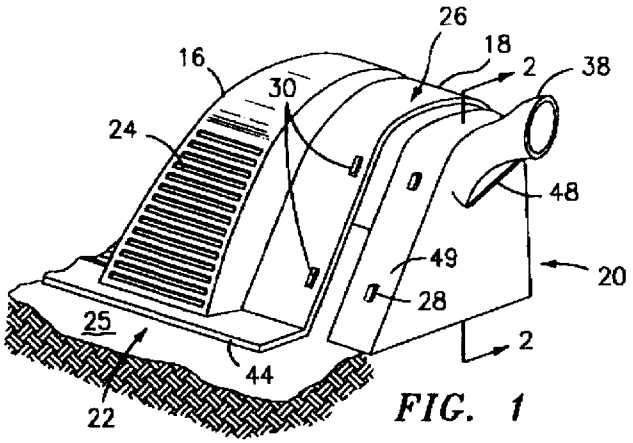
FIG. 1 shows an endplate in position before its insertion into the end of a leaching chamber.

FIG. 1 shows a portion of an arch shape cross section chamber 22 with a spaced-apart endplate 20, just before insertion of the arch shape endplate body into the chamber open end 26. The chamber 22 has features like those taught by the patents referred to above. Peaks 16 and valleys 18 run across the arch comprising corrugations which give strength. In the generality of the invention, an endplate will be used on an uncorrugated chamber. Slots 24 run lengthwise along the opposing sidewalls. The chamber base 44 is comprised of two spaced apart flanges running lengthwise, with an open space therebetween, so soil 25 on which the chamber rests is exposed to liquid entering the chamber.

The chamber open end 26 is shown being at a valley corrugation, but it may alternately be at a peak. The end 26 is adapted to receive and join to a mating chamber so a string of chambers may be created; or, to receive endplate 20. The endplate 20 has an arch shape portion, shaped to slip-fit into the open end 26. The endplate has tabs 28 which engage openings or depressions 30 on the interior of side wall of the chamber, to hold it in place. Other means for fastening in place may be used, such as screws.

Figure 2:
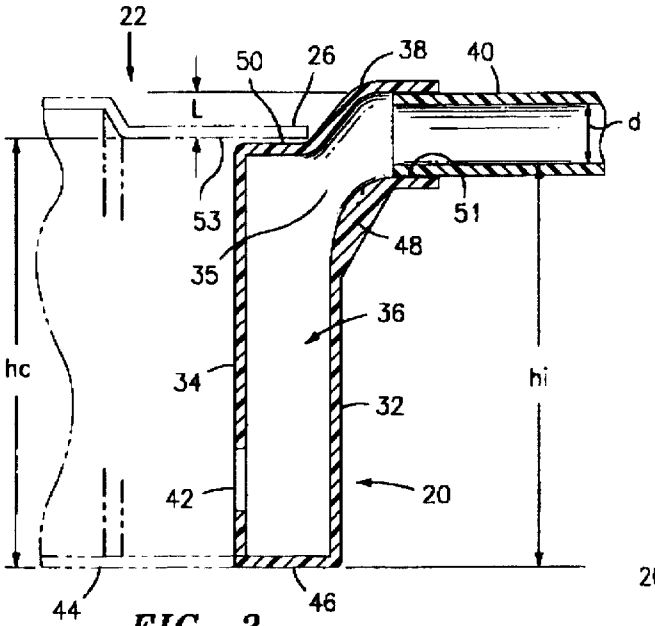
FIG. 2 is a cross section of the endplate of FIG. 1.

FIG. 2 shows a vertical centerline cross section through the endplate of FIG. 1, inserted into the open end of chamber 22, now shown in phantom. With reference to FIGS. 1 and 2, the arch shape portion of the endplate has a top 50. The endplate is hollow; it has an outer wall 32 and an inner wall 34, connected by sidewalls 49. The endplate walls thus define an interior channel 36 running from top to bottom. The endplate has a short base 46, extending into the interior of the chamber.

At the top of the arch shape portion of the endplate is a hole 35 in the outer wall from which liquid enters the top of the channel. Connected to the hole is a circular duct 38, supported by gusset 48. The free end of the duct comprises inlet 51; its top is higher in elevation than the top 50 of the arch shape portion of the endplate. The opening of inlet 51 is shaped to receive a round pipe 40 having an inside diameter d, shown in phantom. The inlet 51 may be stepped or shouldered to have different diameters, to make it adapted to receive different nominal size pipes, e.g., 10 cm (4 inch) or 14 cm (5.5 inch). When a shouldered inlet is used, a reference herein to the duct inlet opening refers to the largest diameter of the opening. The opening of inlet 51 (and pipe 20) has an invert elevation hi, measured from the datum which is the chamber base 44.

The top of the opening of inlet 51 of the duct is a vertical distance L above the top 53 of the arch shape of chamber where the endplate fits, i.e., L>0. Alternately stated, the elevation of the top of the opening of inlet 51 is greater than the height hc of the top of the chamber in the vicinity of the endplate, i.e., (hi+d)>hc. Equivalently through algebra, the elevation of the invert of the inlet 51 is greater than the height hc of the chamber end 20 proximate the endplate, less the inlet diameter d. In practice, it is usually desirable to minimize the total height of the endplate. So, for a particular chamber design, the inlet invert height will usually be chosen to be at or slightly above the elevation of the top of the highest perforation in the chamber sidewall.

It should be understood that the dimensions of L, hi and hc, are nominal and are to be reasonably interpreted with regard to the wall thicknesses of the pipe, chamber and endplate. Typical straight wall pipe has 3–6 mm wall thickness, and chamber and endplate wall thicknesses are typically about 3–4 mm. In this context, a distinction would not be made between the invert height of the inlet 51 and the invert height of the pipe which slips into the opening.

The duct inlet will preferably be placed at an elevation such that the invert height is equal or slightly greater than the elevation of the uppermost sidewall perforations of the chamber. Thus, with the invention, slots can be usefully employed on the full height of the sidewall without being limited by the inlet pipe elevation. So, even when slots are present up to the elevation of the top of the chamber, our new endplate will be adapted to fill the chamber without stagnating of liquid in the inlet pipe.

Figure 3:
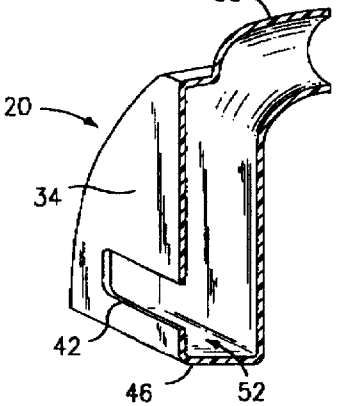
FIG. 3 is a perspective cross section of the vertical endplate of FIG. 1.

Liquid flowing from the duct and hole is guided vertically downward in the channel 36 formed in the arch shape portion of the endplate by the inner and outer vertical walls and opposing sloped endplate sidewalls. The liquid lands on the base 46 of the endplate attached to the bottom of the outer vertical wall. In endplate 20 of FIGS. 2 and 3, there is a horizontal slot opening 42 in the lower part of the inner wall 34. It has an area preferably equal or greater than the minimum area of the duct 38. As shown by FIG. 3 the inner wall opening 42 is positioned a short distance above the bottom 46 of the endplate. Thus, there is a cavity 52 at the bottom of the endplate where liquid can accumulate, along with any heavier particulate, to diminish the erosive force of descending liquid on the soil inside the chamber.

Figure 4:
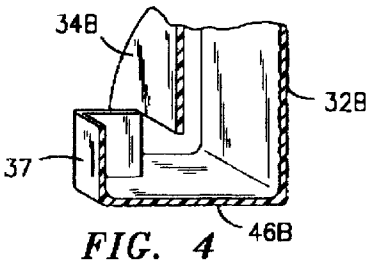
FIG. 4 is a perspective view like FIG. 3, showing a portion of an endplate having a longer base than the endplate of FIG. 3.

FIG. 4 is a view like FIG. 3, showing an alternate embodiment double wall endplate. The elements of the alternate embodiments which are numbered with suffixes correspond with elements in other embodiments having the same digit. The base 46B is longer and the bottom part 37 of the inner wall 34B is displaced longitudinally from the main part of the inner wall 34B, to provide a bigger cavity at the bottom of the endplate.

Figure 8:
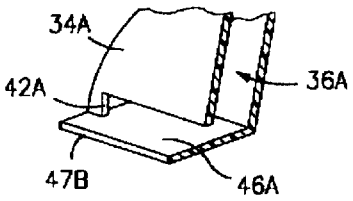
FIG. 8 is a perspective view like FIG. 4, showing an endplate having a slot opening at the level of the base.

FIG. 8 shows another embodiment. The slot 42A in inner wall 34A is at the bottom of the endplate channel 36A. The base 46A runs extends longitudinally (in the same direction as the length of the chamber), running from the outer wall, to and beyond the inner wall, terminating at outer edge 47B. Thus, liquid from the opening 42A flows longitudinally, and to a degree laterally, across the extended base, discharging with diminished force onto the soil within the chamber and reducing tendency for erosion. The extended base feature may be employed with endplate 20 of FIG. 2, so there would be a flange or longitudinal projection into the chamber beyond the plane of inner wall 34.

While a slot at the inner wall location is preferred, other shape openings, such as spaced apart circular holes, may be used on the inner wall.

Figure 5:
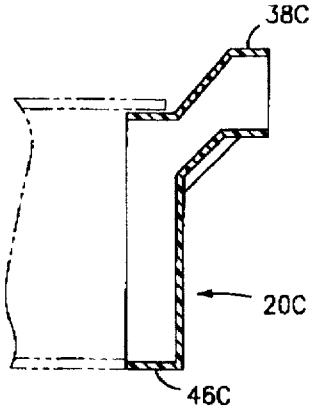
FIG. 5 is a vertical cross section similar to FIG. 2, showing a single wall endplate without a vertical running channel.

FIG. 5 shows a single wall endplate 20C, with a duct 38C like that described above. The base 46C extends longitudinally a relatively short distance, but still sufficiently to be effective and prevent erosion for many applications.

Figure 6:
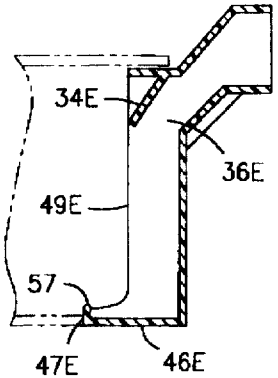
FIG. 6 is a vertical cross section of a single wall endplate having a short vertical channel and an extended base.

FIG. 6 shows another single wall endplate. Base 46E extends longitudinally further than the inner edge of endplate sidewall 49E. The endplate has a sloped inner wall 34E of comparatively short vertical length, to define channel 36E. A short height third wall 57, or dam, projects vertically is at the outermost edge 47E of the base, to impede force of liquid flow.

Figure 7:
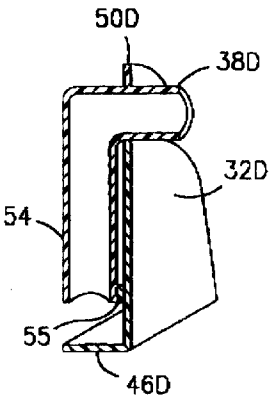
FIG. 7 shows a single wall endplate having a vertical channel spaced apart from the wall.

FIG. 7 shows still another endplate embodiment, where the inlet opening of duct 38D is at a lesser elevation than the top 50D of the endplate's arch portion. At the interior side of the single endplate wall 32D, the duct connects with a circular pipe-like channel 54, running vertically downward toward the base 46D. The channel is slightly spaced apart from the wall 32D, being attached at its lower end by bracket 55. Alternately, the channel may be fastened along its length to the wall. The channel discharges the liquid onto the base 46D, and then onto the soil in the chamber.

Figure 9:
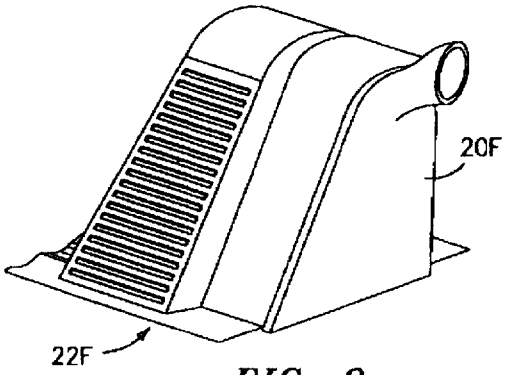
FIG. 9 is an end view of a relatively narrow width chamber with slots almost to the top, showing how the endplate provides a commensurate high invert elevation.

FIG. 9 shows a part of the end of chamber 22F having a relatively narrow width at the top of the arch. Slots run on the sidewalls virtually to the top. Thus, with the old style endplate, a pipe could not be postioned at sufficient height to utilize the chamber leaching capacity. Even if it might fit in the opening, there would be insufficient endplate structure to retain it. With use of the invention endplate 20F, as shown, the duct is shaped appropriately and has an inlet of sufficient dimension to receive the pipe.

In generality of one aspect of the invention, a leaching chamber has an endplate which enables an inlet pipe to have higher elevation than in the prior art systems. Such feature may be characterized in either of two ways: First, in that the top of the inlet opening of the duct, or the inlet pipe received therein, is higher than the top of the interior part of the chamber proximate the endplate. Second, in that the inlet/inlet pipe invert height is greater than the height of the proximate top of the chamber, minus one inlet pipe diameter.

Figure 10:
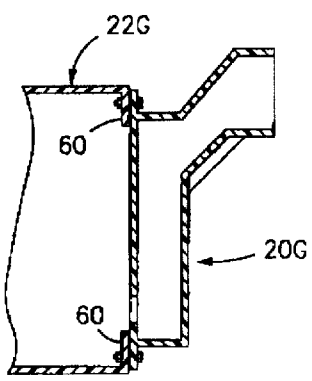
FIG. 10 is a schematic representation of a vertical cross section of an end plate attached to a flanged chamber end.

While the endplates are shown as slipping inside the opening of the chamber end, they may instead slip over the outside, or join with flanges at the end of the chamber. As schematically shown in FIG. 10, for example, an end plate 20G may attach to a chamber 22G by attaching at flanges 60. Since a double wall end plate slip fits into the chamber, it will be evident that the sidewalls connecting the inner and outer endplate walls do not have to be continuous, since the close fitting chamber sidewalls will substitutionally function the same.

The invention has been shown in application to a curved arch shaped cross section chamber. However, the term arch shape will encompass cross section shapes such as trapezoid, triangle, rectangle, and so forth.

Although only the preferred embodiment with some alternatives have been described, it will be understood that further changes in form and detail may be made without departing from the spirit and scope of the claimed invention.

We claim:

1. In a leaching chamber for dispersing liquids in soil, of the type having an arch shape cross section defining a hollow interior with open ends, and sidewalls with perforations enabling passage of liquids therethrough, the improvement which comprises: an endplate, attached to an open end of the chamber, wherein the endplate comprises:

a vertical wall closing the open end of the interior of the chamber, the wall having a hole in the upper portion thereof;

a duct, attached to the upper portion of the endplate vertical wall in communication with said hole, the duct having a free end with an inlet shaped to receive a pipe, for passage of liquid through the endplate wall and into the leaching chamber;

wherein, the elevation of the top of the duct inlet is higher than the elevation of the top of the arch shape cross section of the chamber proximate the endplate.

2. The chamber of claim 1 wherein the duct inlet has an invert height at least equal to the elevation of the Uppermost perforation of the chamber sidewall.

3. The chamber of claim 1 wherein the chamber has an open bottom, and wherein the endplate further comprises an endplate base, attached to and extending longitudinally and horizontally from the bottom of said vertical wall into the chamber interior, to lessen erosion of the soil by liquid flowing from the inlet duct.

4. In a leaching chamber, for dispersing liquids in soil, of the type having an arch shape cross section defining a hollow interior with open ends, and sidewalls with perforations enabling passage of liquids therethrough, the improvement which comprises: an endplate attached to an open end of the chamber, comprising a vertical wall closing the open end of the chamber;

an opening at the upper portion of the endplate wall, for passage of liquid through the vertical wall; and, a channel running vertically downward from said opening and along the the side of the endplate wall facing the interior of the chamber, for guiding liquid flowing through the opening downwardly toward the base of the chamber.

5. The chamber of claim 4 further comprising: a duct, attached to the upper portion of the endplate vertical wall in communication with said hole, the duct having a free end with an inlet shaped to receive a pipe, for passage of liquid to the hole and into the channel.

6. The chamber of claim 4 further comprising: an endplate base connected to the endplate vertical wall, extending into the interior of the chamber.

7. The chamber of claim 4 wherein the channel is comprised of: said vertical wall, as an outer wall; a second wall, as an inner wall, spaced apart longitudinally from the outer wall toward the interior of the chamber; and, endplate sidewalls connecting the inner and outer walls.

8. The chamber of claim 7 wherein the endplate outer wall is arch shaped to fit inside the arch shape cross section of the end of the chamber; wherein the endplate is connected to the chamber by fitting within the arch shape cross section at the end of the chamber; and, wherein the sidewalls connecting the inner and outer walls are continuous along the vertical length of the endplate.

9. The chamber of claim 4 wherein the channel is comprised of said vertical wall and a short angled baffle attached to the vertical wall near the top thereof.

10. The chamber of claim 7 wherein the inner wall has an opening near the base, for passage of liquids from the channel to the interior of the chamber.

11. The chamber of claim 10 wherein the inner wall opening is vertically spaced apart from the base; the lower parts of the inner wall, outer wall, and sidewalls forming a cavity at the bottom of the endplate, for receiving liquid from the channel prior to the liquid flowing through the opening and into the chamber.

12. In a leaching chamber for dispersing liquids in soil, of the type having an arch shape cross section, hollow interior and open ends, sidewalls with perforations enabling passage of liquids therethrough, and a base enabling enabling liquids flowed into the chamber to contact soil within the chamber, the improvement which comprises: an endplate attached to an open end of the chamber, comprising a vertical wall attached to and closing the open end of the chamber, the wall having a hole near the top thereof;

a base extending longitudinally into the chamber from the bottom of the vertical wall;

a duct, attached to the vertical wall near the top thereof, communicating with said vertical wall hole, having an end with an inlet shaped to receive a pipe carrying liquid to the chamber; and, a channel running along the side of the vertical wall which faces the interior of the chamber, for guiding liquid vertically downwardly from the duct toward the base.

13. The chamber of claim 12 wherein the channel is comprised of said vertical wall as an outer wall; a second wall, as an inner wall, running at least in part vertically, spaced apart longitudinally toward the interior of the chamber; and, endplate sidewalls connecting the inner and outer walls; the inner wall having an opening near the bottom of the endplate, to enable liquid to flow from the channel into the chamber.

14. The chamber of claim 13 wherein the lower part of the inner wall below the inner wall opening is longitudinally farther spaced apart from the outer wall than is the upper part of the inner wall above said opening.

15. An endplate for closing the end of an arch shape leaching leaching chamber used for dispersing liquids in soil, comprising:

an arch shape portion adapted to connect to and close the end of a leaching chamber;

the arch shape portion having a vertical outer wall, a spaced apart inner wall, and opposing sidewalls connecting the inner and outer walls, the combination of walls forming a vertically running channel within the arch shape portion for guiding liquids downwardly therein;

the outer wall having an opening near the top thereof, for passage of liquids into the channel from outside the chamber;

the inner wall having an opening near the lower end thereof, to enable liquids to pass from the channel into the interior of a chamber;

a base extending laterally from the bottom of the outer wall to the vicinity of the plane of the inner wall;

a duct, attached to the upper end of the outer wall in communication with the hole and channel, extending from the outer wall to an end comprising a duct inlet, adapted to receive a pipe carrying liquid into the leaching chamber;

wherein, the elevation of the top of the duct inlet is higher than the elevation of the top of the arch shape portion.

* * * * *

UNITED STATES PATENT AND TRADEMARK OFFICE

CERTIFICATE OF CORRECTION

PATENT NO. : 5,839,844

DATED : November 24, 1998

INVENTOR(S) : Nichols et al.

It is certified that error appears in the above-indentified patent and that said Letters Patent is hereby corrected as shown below:

column 8, line 19, change "hole" to --opening--

Signed and Sealed this

Sixth Day of April, 1999

*Attest:*

Q. TODD DICKINSON

*Attesting Officer*

*Acting Commissioner of Patents and Trademarks*